US007431661B1

(12) United States Patent
Cailey

(10) Patent No.: US 7,431,661 B1
(45) Date of Patent: Oct. 7, 2008

(54) MODULAR GOLF SWING AND PUTTING TRAINER

(76) Inventor: Ronald J. Cailey, 745 Lake George Trail, Traverse City, MI (US) 49686

( * ) Notice: Subject to any disclaimer, the term of this patent is extended or adjusted under 35 U.S.C. 154(b) by 0 days.

(21) Appl. No.: 11/424,464

(22) Filed: Jun. 15, 2006

(51) Int. Cl.
*A63B 69/36* (2006.01)

(52) U.S. Cl. ..... 473/257; 473/262; 473/266

(58) Field of Classification Search ..... 473/226, 473/227, 257, 261–266, 269, 270, 271–277, 473/422, 451, 453
See application file for complete search history.

(56) References Cited

U.S. PATENT DOCUMENTS

| | | | | |
|---|---|---|---|---|
| 4,688,800 | A | 8/1987 | Lopez | |
| 4,900,030 | A * | 2/1990 | Houtz | 473/258 |
| 4,993,716 | A * | 2/1991 | Waller | 473/275 |
| 5,303,926 | A * | 4/1994 | Owens et al. | 473/261 |
| 5,707,300 | A | 1/1998 | May et al. | |
| 6,579,195 | B2 * | 6/2003 | Lamb | 473/417 |
| 6,780,120 | B2 * | 8/2004 | Murray | 473/239 |
| 6,932,712 | B2 | 4/2005 | Cardosi | |
| 7,150,683 | B2 * | 12/2006 | Bender | 473/266 |
| 2005/0197199 | A1 | 9/2005 | Cardosi | |
| 2005/0209015 | A1 * | 9/2005 | Costa et al. | 473/257 |

OTHER PUBLICATIONS

Dr. Jim Suttie, Finishing School, http://www.golftipsmag.com/content/2005/novdec/finishingschool.pdf, Nov.-Dec. 2005, p. 6 of 10 page article, .golftipsmag.com. U.S.

Swing Plane Enterprises, What Is The Plane Stick, http://web.archive.org/web/20041020195031/http://www.optimizeit.net/PlaneStick/what.htm, 2001 (2004 archive). U.S.

Train 2 Engrain Sports Corp., Train 2 Engrain, http://web.archive.org/web/20030601162537/train2engrain.com, 2003, 3 pages, www.train2engrain.com, U.S.

Pelz Golf, ChipStick, http://web.archive.org/web/20030610130021/pelzgolf.com/PropShop/Productslist.aspx?Cat..., 2003, 2 pages, www.pelzgolf.com, U.S.

(Continued)

*Primary Examiner*—Nini Legesse
(74) *Attorney, Agent, or Firm*—Northern Michigan Patent Law; Jason Young

(57) ABSTRACT

A golf swing trainer comprising a set of modular cylindrical ground frame members, in the most basic form an elongated front-back member and at least two elongated fore-aft members removably mounted on the front-back member with connections that allow the position and spacing of the fore-aft members to be adjusted on the front-back members to define ground level swing/stroke paths, and one or more tilt-adjustable upright guide members removably and adjustably mounted on the ground frame members to define a swing plane. The ground frame is preferably made from cylindrical tubing, and special connectors are used that provide snap-fit, slide, and rotational connection to the ground frame members. The trainer also includes raised, angled guides that can be removably connected to the ground frame members to support a raised, elongated, horizontal putting guide at a parallel acute angle to a ground frame member. The pieces of the swing trainer can be reconfigured without tools in the field to create different configurations of right-angled ground framing and upright guides and raised horizontal guides for a wide variety of swing training exercises.

6 Claims, 14 Drawing Sheets

OTHER PUBLICATIONS

Golfdigest.com, Breaking 100, on-line magazine article, May 2004, p. 228, www.golfdigest.com, U.S.

Pelz Golf, Putting Track, http://web.archive.org/web/20030407160709/pelzgolf.com/ProShop/ProductDetails.aspx?p..., 2003, 1 page, www.pelzgolf.com, U.S.

Golfdigest.com, Beat the reverse pivot, on-line magazine article, Oct. 2005, p. 50, www.golfdigest.com, U.S.

Golfdigest.com, Don't just get your chip close—make it, on-line magazine article, Dec. 2000, p. 203, www.golfdigest.com.

* cited by examiner

MODULAR GOLF SWING AND PUTTING TRAINER

FIELD OF THE INVENTION

The invention is in the field of golf swing and putting training devices.

BACKGROUND OF THE INVENTION AND DESCRIPTION OF RELATED ART

Good golfers must master consistency in all aspects of the swing. Some of the most important are swing plane alignment, the alignment and path of the club head before and during the swing or stroke (hereafter generally referred to as "swing"), and the golfer's stance and body position before and throughout the swing.

Golf professionals are known to teach swing exercises using field-expedient swing guides, for example: laying club shafts on the ground for club head placement and path alignment; or sticking a club shaft into the ground or placing a golf bag at an angle behind the golfer to define a desired swing plane; or placing an empty cardboard box next to the swing path to be avoided during a swing. There are undoubtedly many more individual, homemade exercises such as these that have been taught to date.

At least some training devices have been specially built to help a golfer practice one or more of these exercises.

"The Plane Stick" by Swing Plane Enterprises has a telescoping, angle-adjustable aluminum rod and target line string mounted to a cross-shaped base. The rod is adjustable to different lengths and upright angles to define different swing planes, and has a foam-padded breakaway sleeve to prevent club damage or player injury in the case of contact with the rod.

The "Putting Track" by the Dave Pelz Corporation is a pair of curved, parallel, adjustably-spaced aluminum bars that provide a check for both putter path and face alignment.

U.S. Pat. No. 6,932,712 and U.S. Published Application No. 2005/0197199 to Cardosi show a training device in the form of an L-shaped, two-part, multi-position arm extending from a raised frame at about knee to waist level, adjustable to different positions and angles to correct a number of common swing errors. In one version the frame includes a raised putting track with a slide that connects to a putter shaft, and a ground mat marked with putting, club face placement, ball placement, and foot placement lines. In another version the frame is a simple upright member extending from a small, unobtrusive base, and appears to be intended for use without the marked mat.

While the foregoing devices appear to work for their intended swing exercises, each appears to be relatively complex and expensive to make, and none (in this inventor's opinion) appears to be comprehensive in its ability to help a golfer practice the many common types of swing plane, stance, club placement, club path, and other professionally-taught full swing, chipping, and putting exercises on his own.

BRIEF SUMMARY OF THE INVENTION

The invention is a simple, easy-to-use, inexpensive, modular swing trainer that is believed capable of mimicking most commonly taught golf swing and putting exercises for most clubs and shots. Thus, the invention offers a comprehensive training aid for all aspects of the full swing, short game, and putting. The trainer in its most basic form provides a ground-level base frame with a front-back guide member and at least two fore-aft guide members connected at right angles to the front-back guide member, at least one of the fore-aft guide members being removably mounted on and adjustable along the length of the front-back member. In a preferred form all of the fore-aft members are removable and adjustable. These right-angled guide members define an adjustable, ground-level alignment frame for gauging stance, club placement and alignment, and swing path. In the most preferred form, the ground-level alignment frame is made from cylindrical plastic tubing.

The ground-level alignment frame serves as a base for one or more upright guide rods mounted to the ground frame members with a simple, friction-based, tilt-adjustable connection. The upright guide rods serve primarily as swing plane guides, either singly or in pairs, and are preferably padded to soften any contact with a club or part of a golfer's body during a swing. The uprights are removably connected to the ground frame members, and can be positioned at different locations along the length of the ground frame members, and in the most preferred form the tilt-adjustable connection is adjustable in multiple planes. The upright guide rods can be axially coupled to create a single taller upright guide rod. A padded upright guide rod can also be removed and laid on the ground alongside a ground frame member to cushion and protect the ground frame and club head from damage during certain swing exercises.

In yet a further form of the invention, shorter frame members can be mounted at a raised angle on the ground frame members to support a tensioned cord or elongated tube between them as a raised putting guide.

The invention further includes novel snap-on, slide-adjustable connectors for use with the preferred cylindrical ground frame members. In one preferred form the connectors between some of the members have viewing windows cooperating with markings on the ground frame members to accurately gauge adjustments and placements. In another preferred form the connectors for the upright guides have multi-axis adjustments with a nearly 180-degree fore-aft breakaway function to protect the club and the golfer.

The ground frame and uprights can be made from simple plastic tubing, and with their connectors and other parts can be sold in a modular kit form with all necessary pieces to reconfigure the trainer for many commonly taught swing exercises. The trainer can be used indoors and out, and can be broken down into an easily transported package.

The kit can also include a novel frictional grip connector that allows one of the ground frame tubes to be removably secured to the end of a golf club grip as a breakaway coaxial extension of the grip, useful for certain chipping exercises.

These and other features and advantages of the invention will become apparent upon further reading, in light of the accompanying drawings.

DETAILED DESCRIPTION OF THE INVENTION

Figure 1:
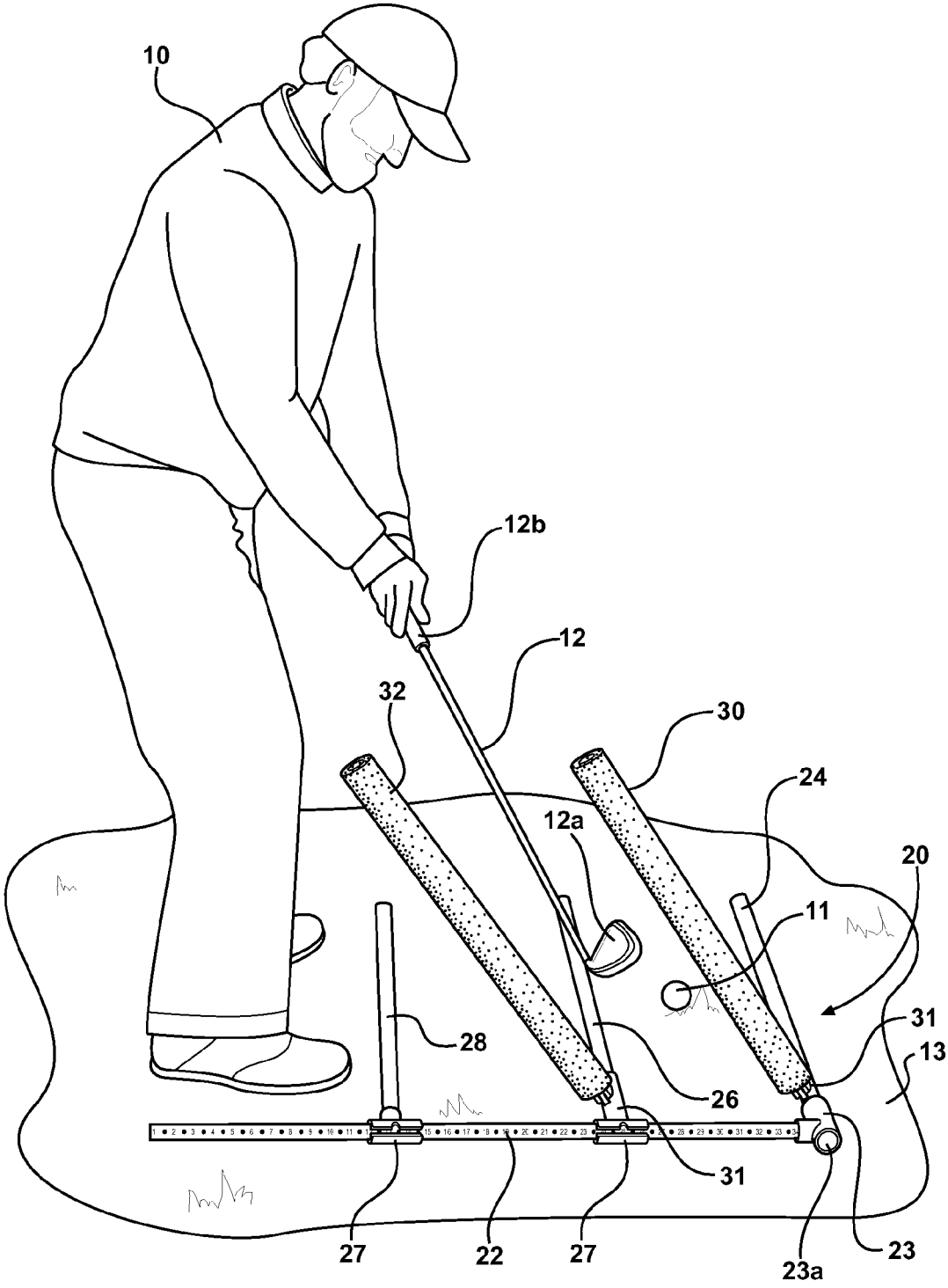
FIG. 1 is an aft (of the swing) perspective view of a golfer using a swing trainer according to the invention for both stance and swing plane alignment.

Referring to FIG. 1, a golfer 10 is illustrated as he begins taking his club 12 back for a swing at ball 11, with the golfer, ball, and club all being positioned within a frame of reference defined by swing trainer 20 for proper alignment. Swing trainer 20 has a ground-level alignment frame defined by a front-back (relative to the direction the golfer is facing) frame member 22 and at least two fore-aft (relative to the direction of the swing) frame members 24 and 26 connected at right angles to frame member 22. At least one of the fore-aft ground frame members is both removably connected to and adjustable along the length of the front-back member 22. By "ground-level" is meant that the ground frame members when assembled in a plane lie essentially flat on the ground or surface 13 on which the golf swing exercise is being practiced.

In the illustrated embodiment of FIG. 1, trainer 20 is configured with three fore-aft members 24, 26, and 28 connected at right angles to front-back member 22, with the "L" formed by 22 and 24 subdivided into a swing path guide for the club head 12*a* between the parallel members 24 and 26, and a stance-spacing/positioning framework defined by the parallel spacing between 24 and 26 and 28. Trainer 20 also includes two upright guide members 30 and 32, both padded and tilt adjustable to define a swing plane between them for club 12, especially for clubs used with a shorter swing.

Ground frame members 22, 24, 26, and 28 and upright guides 30 and 32 are preferably made of cylindrical plastic tubing, for example from one of the common varieties of PVC pipe (with optional foam padding added over the PVC tube core in the case of the uprights), and for reading ease will be referred to hereafter as "tubes" for the ground members and "rods" for the uprights. It will be understood that the use of these terms is not intended to limit the construction of either the ground frame members or the upright members to tubing or solid rods or to any particular cross-sectional shape, since non-cylindrical and both solid and hollow frame members formed from plastics or other materials could also be used.

Outermost fore-aft frame member 24 is removably connected to front-back member 22 with a standard PVC "tee" connector 23. Fore-aft members 26 and 28 are connected to front-back member 22 with novel snap-fit connectors 27. Connectors 27 can be detached and reattached to front-back member 22 at different locations, or slide-adjusted along front-back member 22, to adjust the fore-aft members along the length of front-back member 22. In the preferred, illustrated form, connectors 27 have both a snap-fit and a sliding friction fit with front-back member 22 to allow infinite adjustment of the fore-aft members 26 and 28 along its length.

Figure 1A:
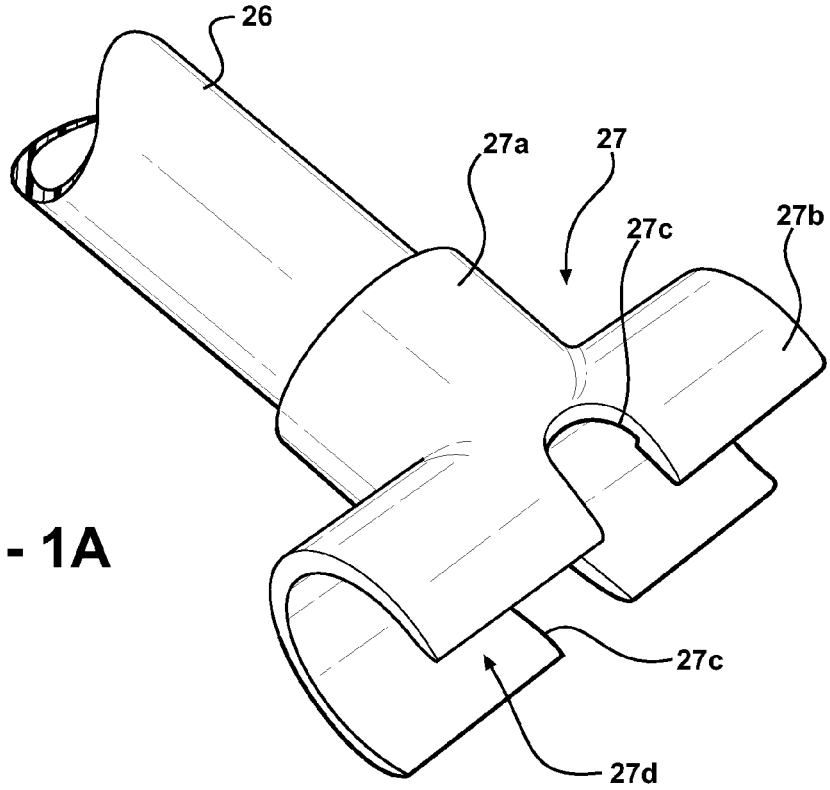
FIG. 1A is an exploded perspective detail view of one of the connections between a fore-aft ground frame member and the front-back ground frame member of FIG. 1.

FIG. 1A gives a detailed view of one of connectors 27, sized in the illustrated embodiment to fit over ¾-inch pipe size PVC tubing. A cylindrical female plug portion 27*a* receives one end of tube 26 in a tapered push-fit that is standard for PVC type fittings; this is preferably a removable connection, but can be made permanent if desired, for example with PVC cement. A saddle portion 27*b* crosses plug 27*a*, the saddle having one or more slots or windows 27*c* formed in the curved sidewalls. Saddle 27*b* is generally U-shaped in cross section, with its open bottom 27*d* being sized to snap onto another ground frame tube as shown in FIG. 1. The fit between saddle 27*b* and the ground frame tube onto which it is snapped preferably allows connector 27 (and tube 26) to both rotate and slide on the ground frame tube, but with sufficient friction to resist unintentional rotation or sliding, and to hold the weight of tube 26 in a raised position if desired. The walls of saddle portion 27*b* can be tapered or thinned for flexibility and to adjust the friction fit. Connector 27 is preferably made from plastic, for example the same PVC material used for the ground frame tubes.

It will be understood that while a standard PVC tee connector 23 is shown for the junction between tubes 22 and 24, one of the snap-fit, slide-adjustable connectors 27 could also be used to join 22 and 24, with corresponding adjustability of the connection. It will likewise be understood that while illustrated adjustable connector 27 is novel and highly preferred for connecting the adjustable fore-aft tubes to front-back tube 22, other forms of right-angled, adjustable connection could be used to attach the adjustable fore-aft members to tube 22. Alternate connectors could be attached to tube 22 in different ways. For example, if tube 22 is not cylindrical, the cross-section of connectors 27 can be modified accordingly. Not all of the fore-aft tubes need to be adjustable along the length of tube 22, and fore-aft tubes that are not adjustable could be connected to tube 22 with appropriate non-adjustable connectors. By way of non-limiting example, tube 22 could be provided in multiple sections, with the multiple sections joined by one or more tee connectors such as 23 that could then be used to non-adjustably connect one or more fore-aft members. And while an indicia-viewing window such as 27*c* is highly preferred in the fore-aft connectors, it will also be understood that adjustable and non-adjustable connectors without such viewing arrangements can be used without departing from the invention.

Figure 1B:
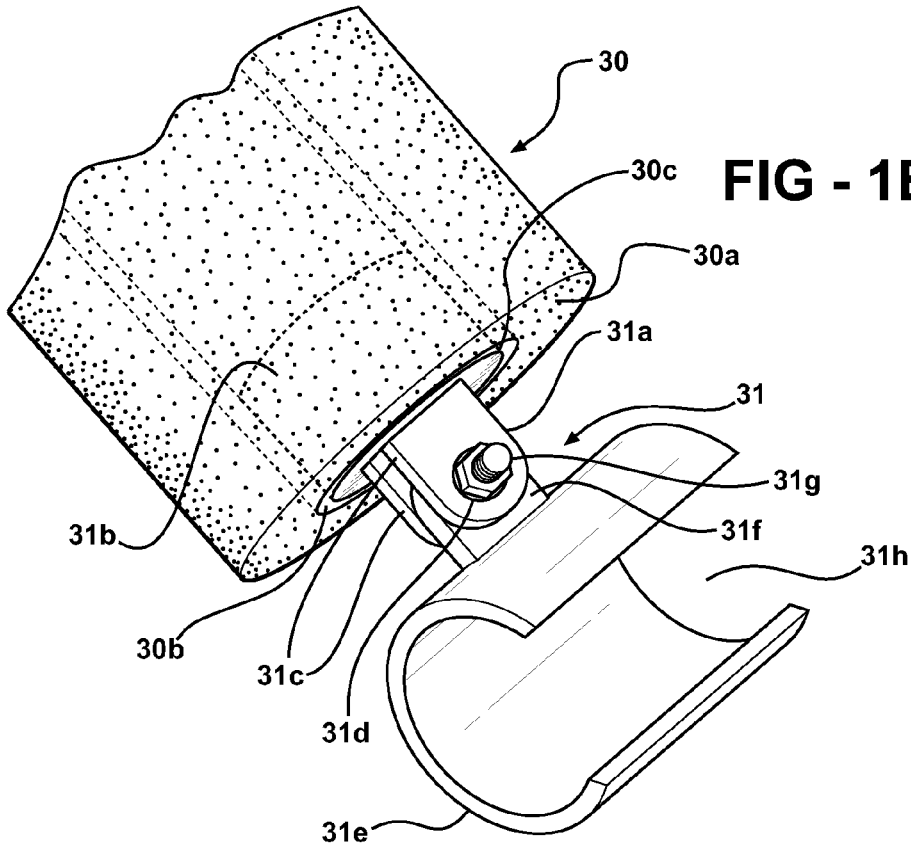
FIG. 1B is an exploded perspective detail view of one of the multi-axis connections between an upright guide rod and a ground frame member.

FIG. 1B gives a detailed view of one of upright connectors 31 and its connection to upright guide rod 30. Connector 31 has a tube clevis 31*a* with an integral male plug 31*b* that fits into the bore 30*c* of PVC inner tube core 30*b* in guide rod 30 with a snug friction fit, preferably removable but with the option of cementing or otherwise securing it in place. The clevis has a pair of spaced arms 31*c* with aligned holes 31*d* for receiving a bolt or pin 31*g* to rotatably secure a snap-on saddle 31*e* via eye 31*f*. Saddle 31*e* snaps onto any of the ground frame tubes via its downward-angled opening 31*h* with a friction fit similar to that of connector 27 described above, allowing both rotational and slide adjustment of connector 31 along the ground frame tube but holding guide rod 30 in a raised, adjusted position and resisting unintended movement. As best shown in FIG. 1D, connector 31 allows upright guide rod 30 to be tiltably adjusted around the axis of bolt 31*g* in a first plane between vertical and various acute angles relative to the ground-level alignment frame, and to be rotatably adjusted in a second plane by rotating saddle 31*e* around the ground frame tube onto which it is snapped. The tilt adjustment in the first plane around bolt 31*g* also provides a nearly 180-degree breakaway function to protect the club and the golfer should the golfer accidentally make contact with the upright guide. Bolt 31*g* can be tightened or loosened to adjust the breakaway force. Connector 31 is primarily made from plastic, for example the same PVC used in the ground frame tubes. It will be understood that connector 31, although novel and highly preferred, is not the only form of tilt-adjustable connector that could be used to attach the upright guide rods to the ground frame members. Nor is it required that the upright connectors offer more than one plane of tilt-adjustment, or that they be limited to two planes of adjustment, since ball-joint connectors with universal adjustability and other forms of connector joint that would allow the upright guide rods to be angled from vertical in one or more planes will be apparent to those skilled in the art. Also see, for example, FIG. 5 below where one of inventive connectors 27 is demonstrated as useful for connecting a guide rod to a ground frame member in an upright position.

Figure 1C:
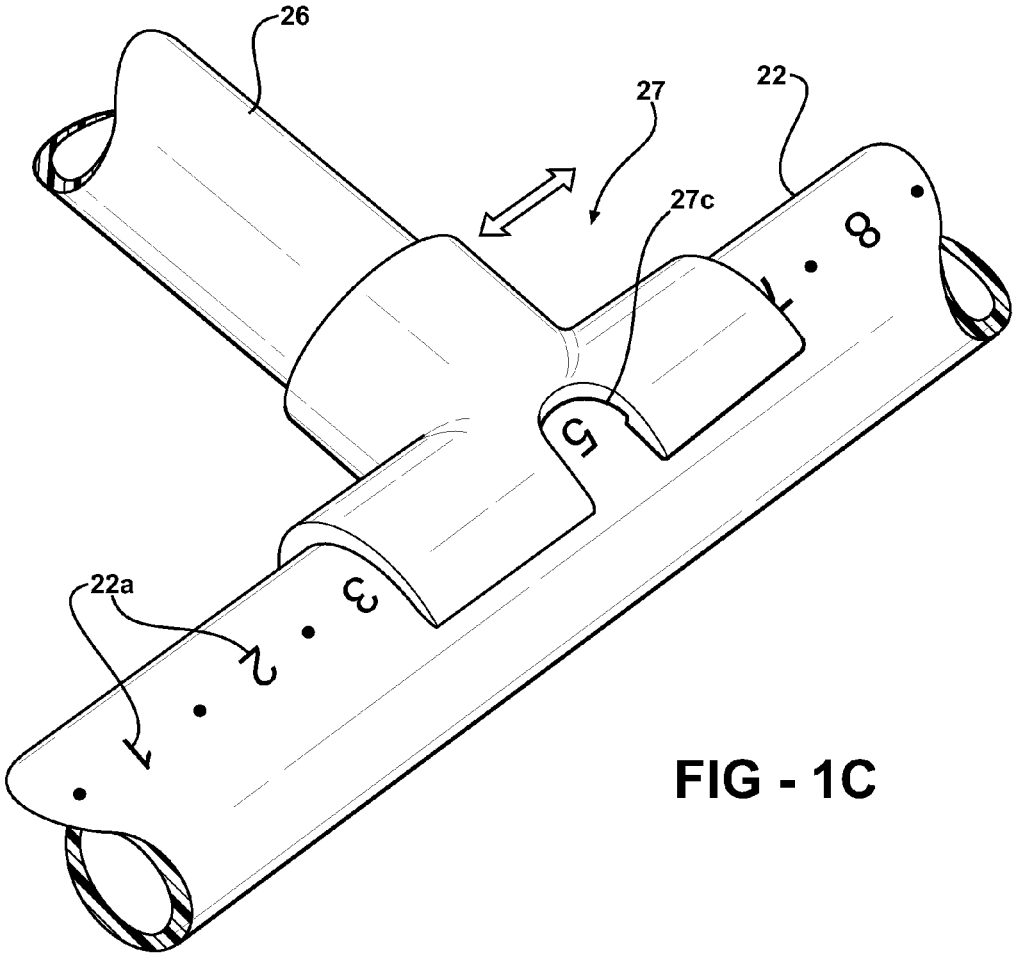
FIG. 1C is a detailed perspective view of one of the connections between a fore-aft ground member and the front-back ground frame member, in which the connector includes a window cooperating with a ruled portion of the front-back member.
Figure 1D:
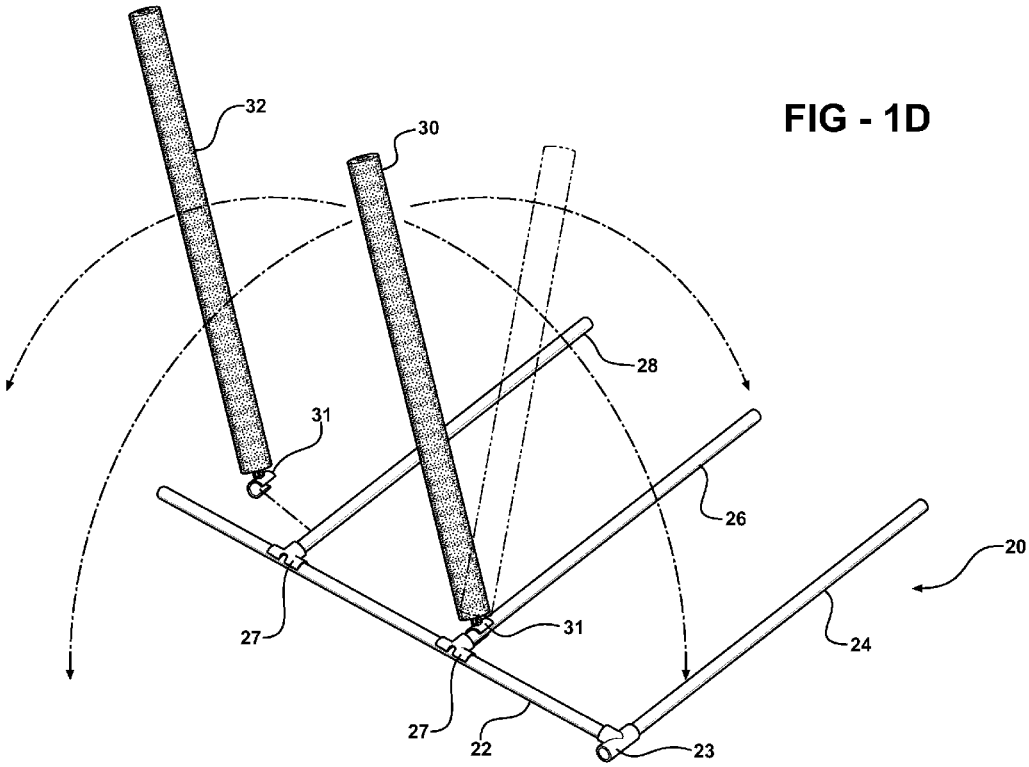
FIG. 1D shows the removable and adjustable nature of the upright guides on the swing trainer of FIG. 1.
Figure 2:
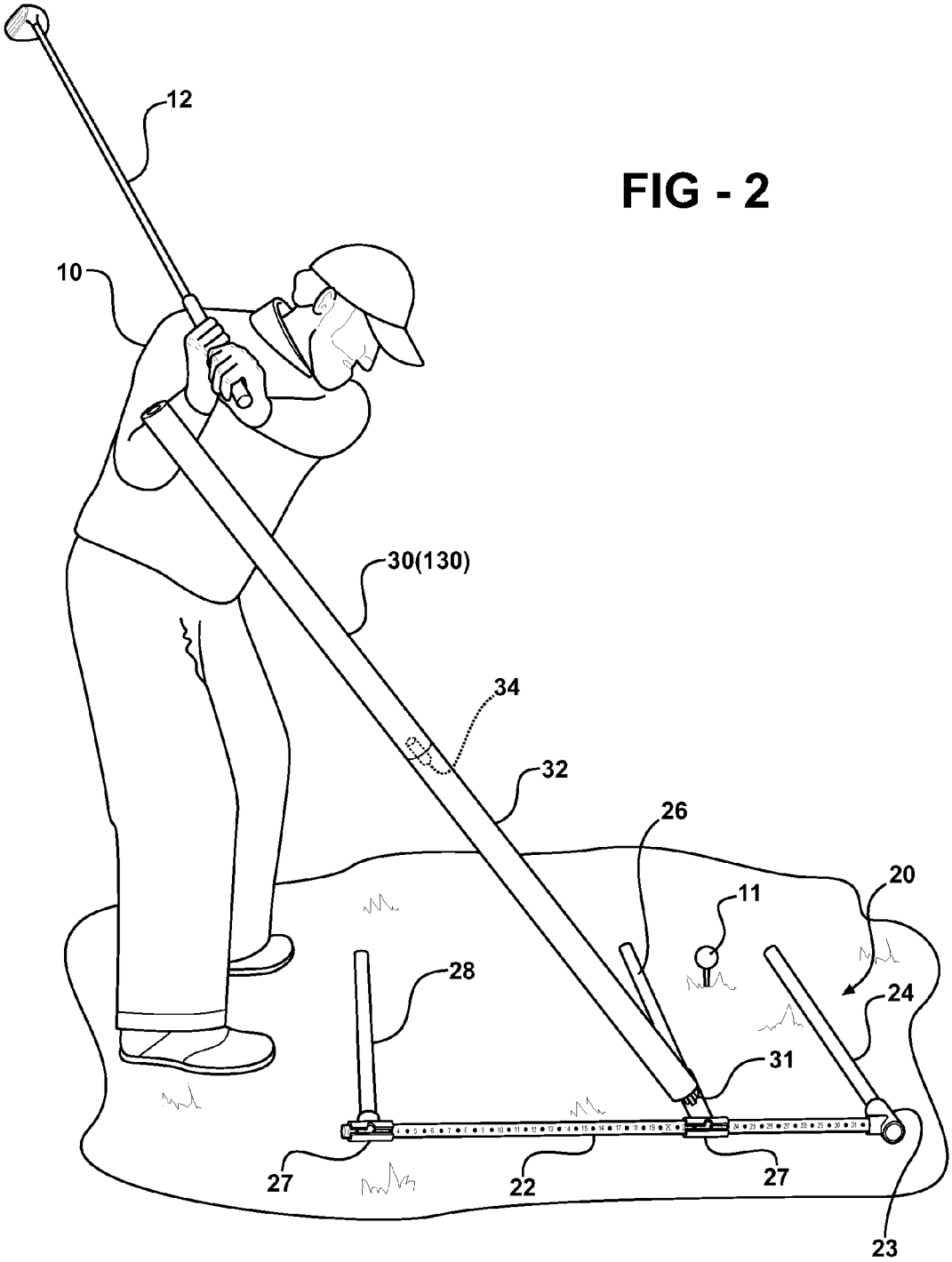
FIG. 2 is an aft perspective view of the uprights in the swing trainer of FIG. 1, axially coupled to form an extended swing plane guide.

FIG. 1C shows connector 27 on the end of tube 26 mounted on a front-back tube 22 provided with visible markings 22*a*, the window 27*c* in the connector providing a clear view and quick reference to the markings. In the illustrated embodiment, the markings 22*a* represent an ascending scale in inches (or any other useful increments) from one end of tube 22 to the other end, letting the golfer know exactly how far tube 26 has been adjusted along tube 22. The usefulness of this feature for optimizing and duplicating foot position relative to the golf ball is best shown in FIGS. 1 and 2, where tube 22 is shown with scale 22*a* visible to the golfer. It should be noted that tubes 22 (and 24) are preferably marked as shown at 22*a* (and 24*a*), best shown in FIG. 9, but that the numbered scales are not shown in every Figure, since for some exercises it might be preferred to rotate the numbered side of the tube down against the ground to prevent visual distraction to the golfer. It will also be understood that other tubes such as 26 and 28 can be provided with the same or different types of visible guide markings. The best placement and use of such visible markings and the tubes so marked can be left to the discretion of the golfer for each particular exercise performed with the reconfigurable swing trainer 20; the examples shown herein are merely currently preferred examples.

Referring to FIG. 2, swing trainer 20 is shown with the upright guide rods 30 and 32 axially coupled to form a single longer swing plane guide, especially useful for guiding both the club shaft and the golfer's arms for the fuller swings used with woods and the long irons. Guide rod 30 has simply been detached from fore-aft member 24, and the end that was uppermost in FIG. 1 has been coupled to the upper end of guide rod 32 with a simple dowel-type plastic connector rod 34 that fits into their respective bores 30*c* and 32*c* in a friction fit. The extension may optionally be formed with a padded rod 130 similar to rod 30, but provided specially for the purpose of extension and having a built-in connector rod 34.

Figure 3:
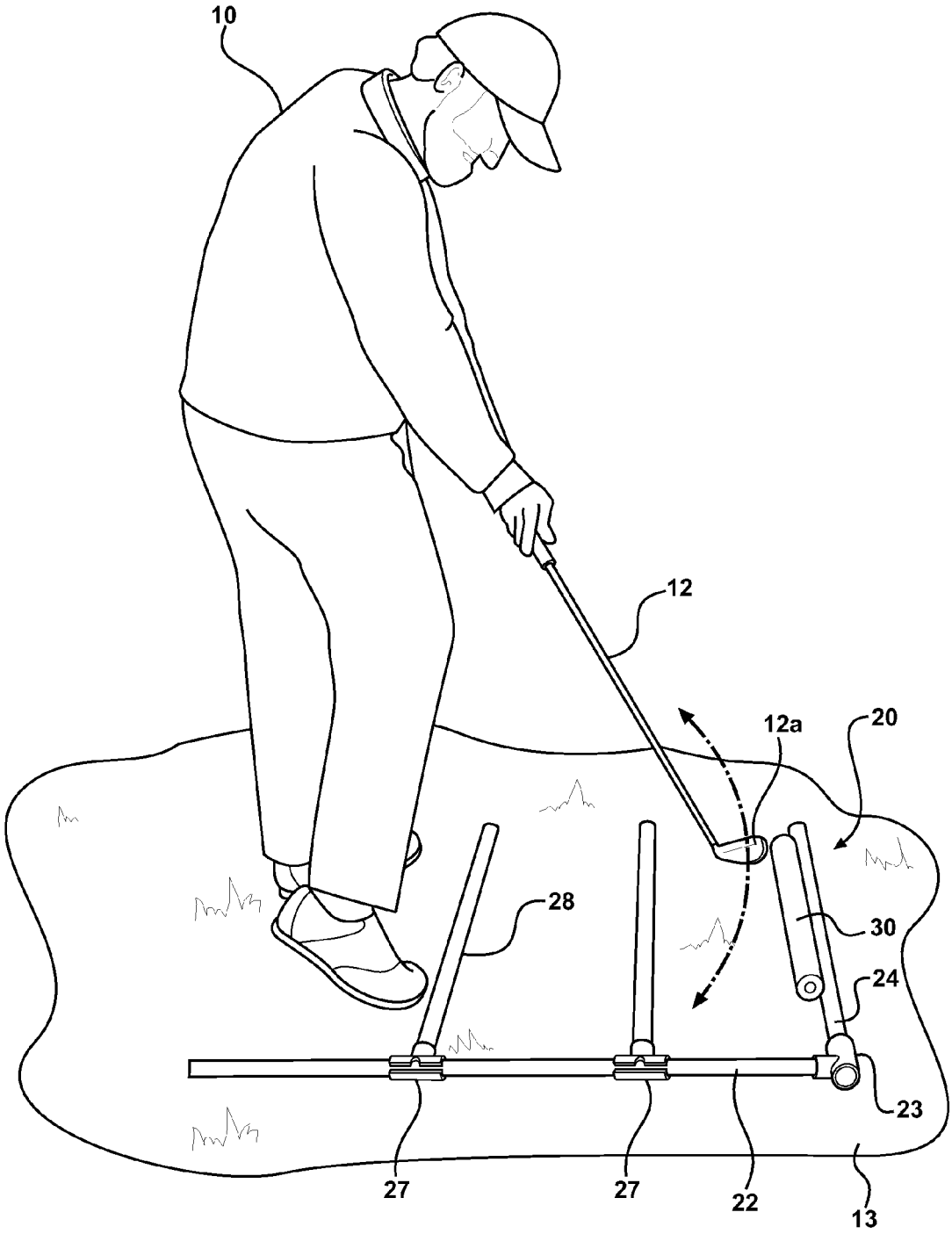
FIG. 3 is an aft perspective view of the swing trainer of FIG. 1, with one of the padded uprights laid on the ground next to a fore-aft member to guide and cushion a club head during a swing exercise.

FIG. 3 shows the swing trainer 20 of FIG. 1 reconfigured for an anti-slicing exercise. Upright guide rods 30 and 32 have been removed, and guide rod 30 (or a similar foam-padded rod included for this purpose) has been laid alongside fore-aft tube 24, just outside the ball and parallel to the target line, to help establish a proper swing path through the ball. This exercise is particularly useful in preventing the error of slicing. A swing too far out of the correct swing path (phantom curved line) either aft or fore of the ball will cause the club head 12*a* to strike padded guide rod 30, letting the golfer know that a correction needs to be made. If hit, the padded rod 30 protects the club head 12*a* and tube 24 from damage, protects the ground frame from moving by independently absorbing the force of the swing, and reduces discomfort to the golfer's hands.

Figure 4:
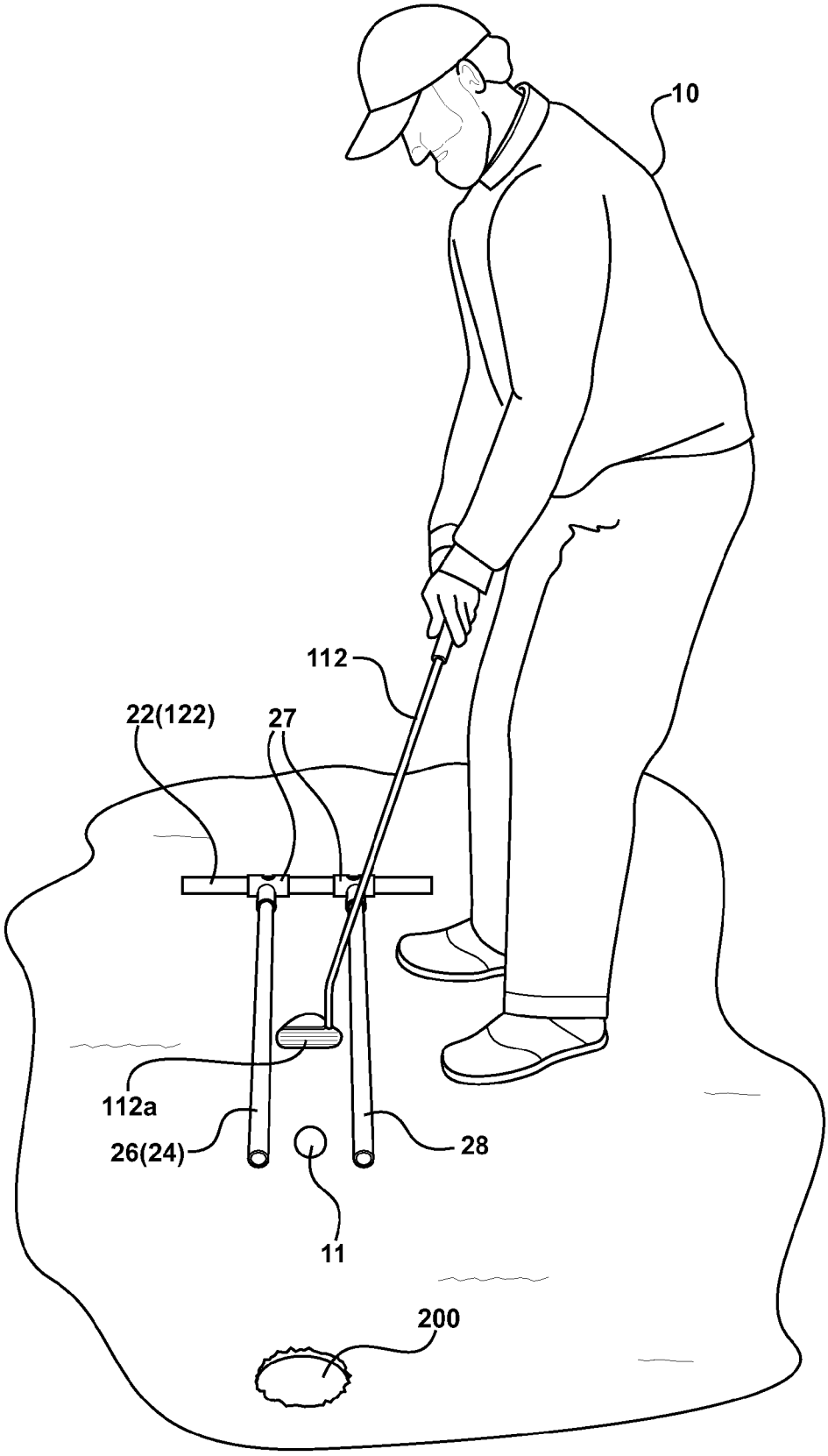
FIG. 4 is a fore (relative to the swing) perspective view of three of the ground frame members of FIG. 1 reconfigured for use as a putter path alignment guide.

FIG. 4 shows the swing trainer reconfigured by adjusting the spacing between fore-aft tubes 26 and 28, and optionally removing fore-aft tube 24. Fore-aft tubes 26 and 28 have been spaced apart just slightly wider than the width of the head 112*a* of putter 112, and define a parallel putter path both fore and aft of ball 11, and aimed at hole 200, to provide a ground-level guide for maintaining a straight putting stroke. If the golfer misaligns the putter's head 112*a* at any point in the stroke, it will be immediately visually apparent relative to the closely spaced parallel tubes 26 and 28. If the golfer swings the putter head 112*a* in an improper arc, the putter head 112*a* will contact one of the tubes 26 or 28, giving the golfer tactile, audible, and visible feedback of the error. In FIG. 4, it may also be preferred to use a visibly-marked fore-aft tube, such as 24, with an aft-zero-fore scale in whatever increments are felt to be most useful (for example, inches). Since most golfers are right-handed and right-eye dominant, they tend not to follow through enough on the putting fore-stroke. The inches scale to the fore of the golf ball provides a visual reminder to overcome the fore-shortening effect of right (rear) eye dominance for most golfers, helping with proper follow-through on the putt. It will be understood that the same applies to left-handed golfers with left-eye dominance, and to the back-stroke where the golfer's eye dominance is opposite that of his handedness.

It should be noticed in FIGS. 1-4 that the ground frame, made from various combinations of tubing 22, 24, 26, and 28, not only defines a right-angled framework to help keep the swing and the club or putter square to the swing, but also provides a right-angled framework for the golfer's feet to align his stance. The junction of tubes 22 and 28 nearest the golfer's feet define a right angle that helps the golfer keep his feet, and thus his whole stance, properly aligned to the swing, which in turn is guided by the remainder of the trainer 20.

Figure 5:
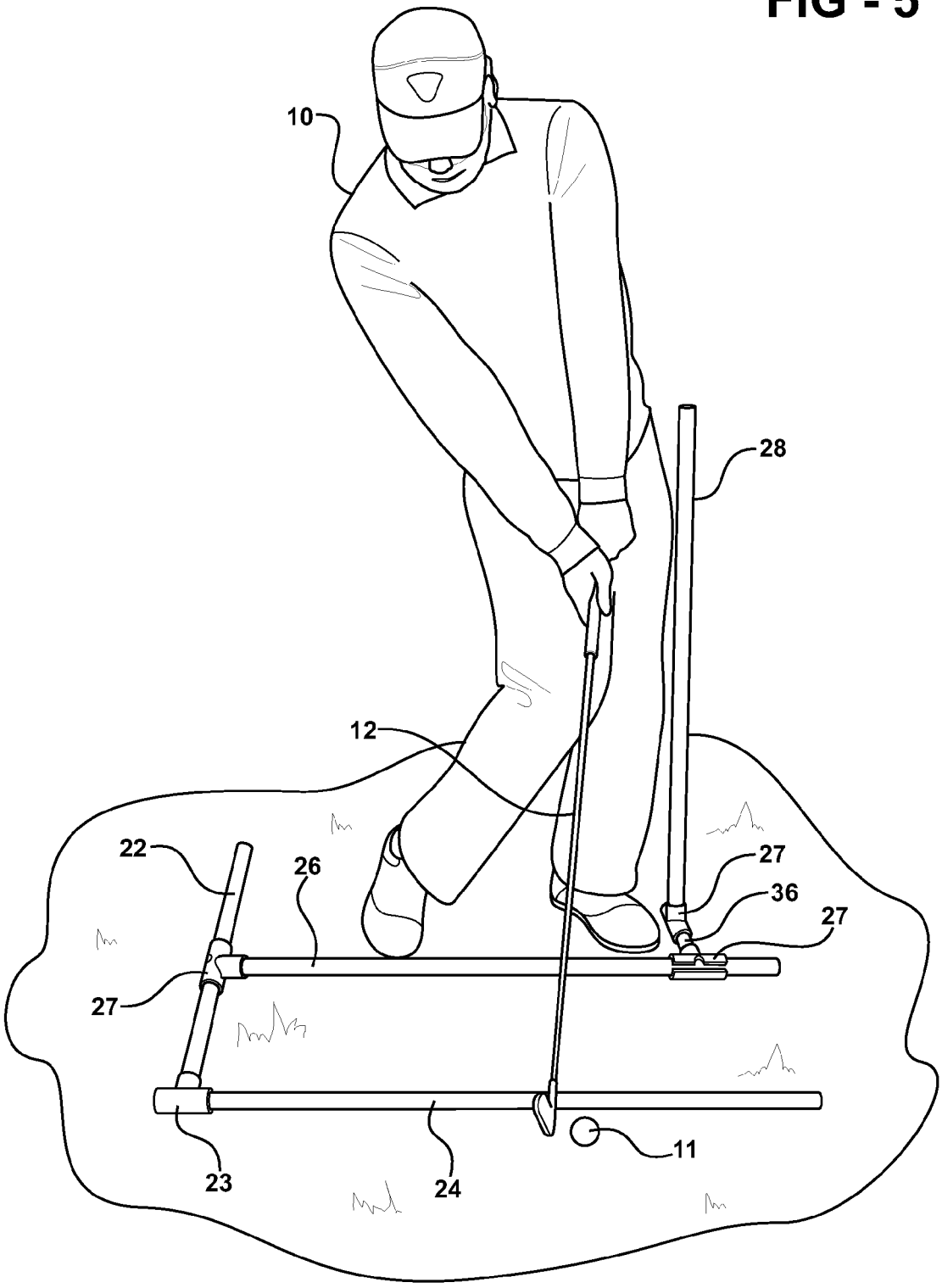
FIG. 5 is a front perspective view of the swing trainer of FIG. 1 reconfigured as a guide for weight shift and rotation during a swing.

FIG. 5 illustrates the ground frame portion of swing trainer 20 reconfigured as a body position guide for an exercise known as "bump the shaft". Fore-aft tube 28 has been removed from front-back tube 22, and re-attached vertically to a short front-back connector tube 36 connected to the fore end of tube 26 with a connector 27 as described above. Tube 28 is accordingly positioned next to the golfer's front (left) foot and the left side of his body, including left leg and hip. The exercise is conducted by "bumping" the left knee against the vertical tube 28 at the start of the downswing to initiate a shift in weight to the left foot; this tactile reminder of the weight shift should precede the beginning of hip rotation in a proper swing. Improper rotation or shifting might move the tube 28 from its vertical position, but the tube can be easily rotated back to vertical via connector 37. Also, certain golfers might find a less-than-vertical starting angle preferable for tube 28, and the friction between connector 37 and extension tube 36 will hold tube 28 at the desired angle once set.

FIG. 5 demonstrates the ability of un-padded ground frame members such as 24, 26, and 28 to be used in place of padded multi-axis uprights such as 30 and 32, and to be connected together in different ways than the basic configuration of FIG. 1. Adjustability is determined by which connector (27 or 31) is used. Of course, padded members such as 30 and 32 could be used in place of vertical tube 28 for the exercise of FIG. 5.

Figure 6:
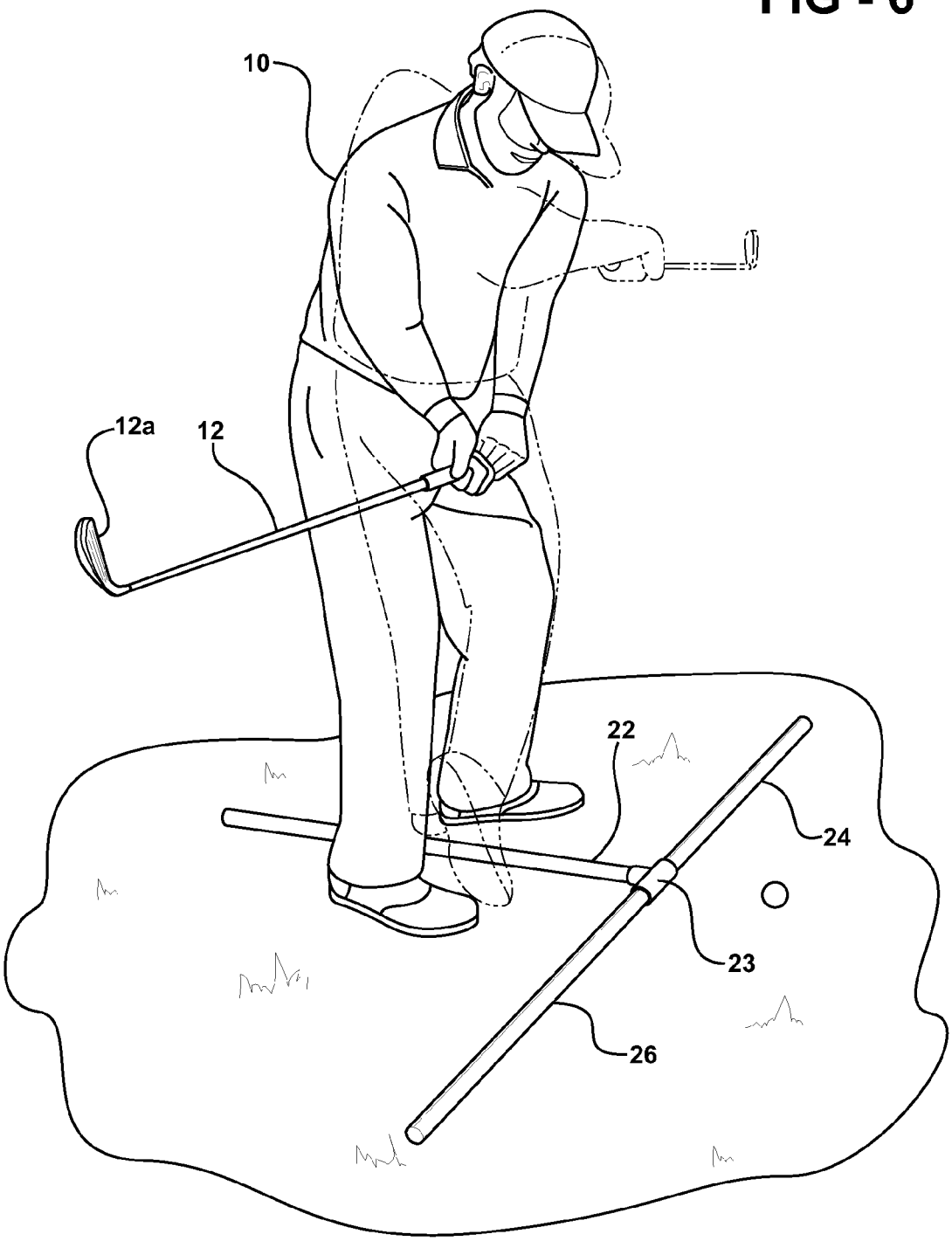
FIG. 6 is an aft perspective view of the ground frame of the swing trainer of FIG. 1 reconfigured for power line stance and swing exercises.

FIG. 6 shows trainer 20 reconfigured in a T-shape, by removing tubes 26 and 28 from tube 22, and by re-attaching one of tubes 26, 28 to the aft end of fore-aft tube 24 with a push-fit to the free (aft) socket 23*a* (FIG. 1) of tee connector 23. The golfer 10 straddles front-back tube 22 with feet on opposite sides, with the ball aligned with tube 22 on the opposite side of the long fore-aft tube 24, 26. The trainer configured in this manner guides the position of the golfer's feet, establishes a visible target line via the fore-aft tubes 24, 26, and visually guides the swing path of the club both fore and aft to define the club shaft's "power line" parallel to the target line through backswing/downswing (solid lines) and release (phantom lines). The line formed by the tubes 24 and 26 is typically aligned parallel with the ball-to-target line of sight.

Figure 7:
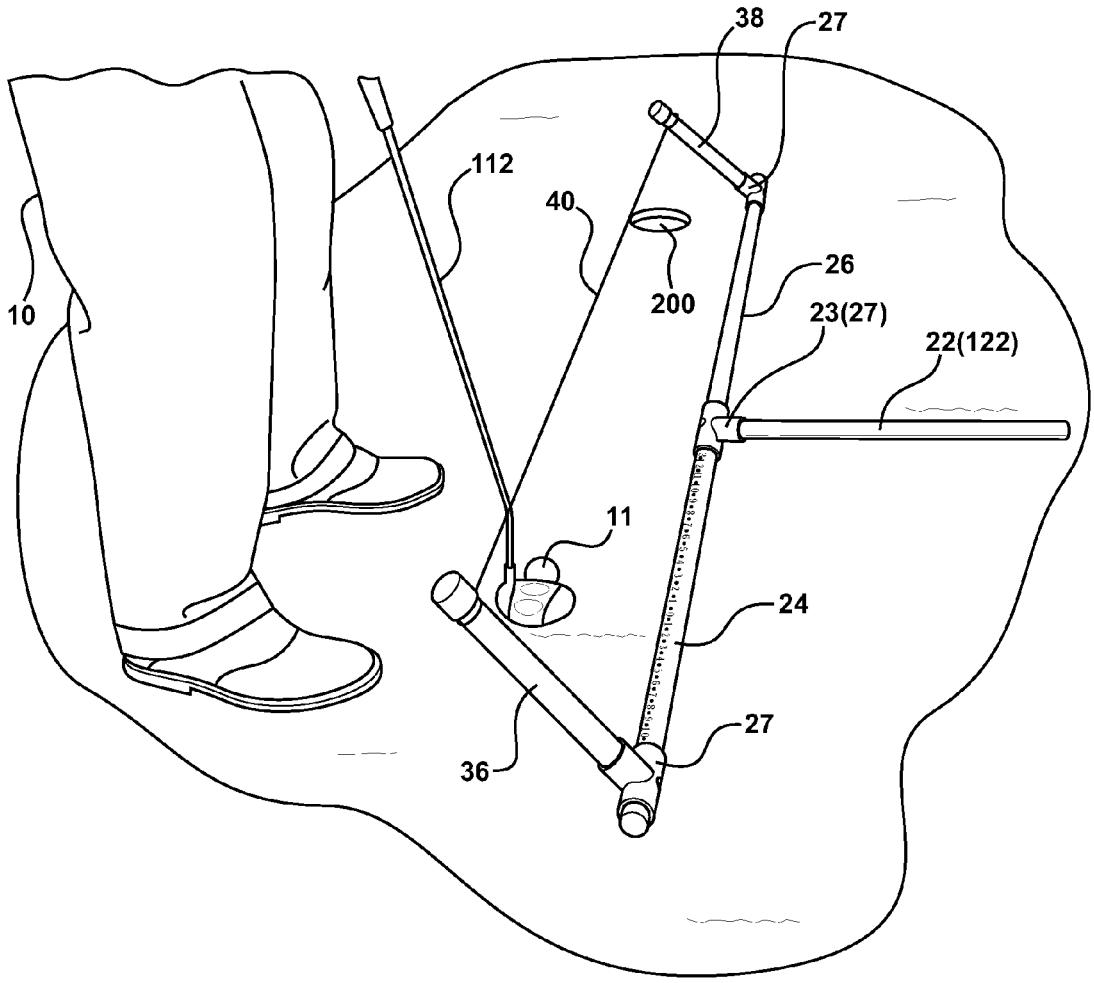
FIG. 7 is an aft perspective view of two shorter angle-mounted frame members connected to the ground frame and supporting a tensioned cord as an over-the-putter putting aid useful both indoors and outdoors.

FIG. 7 shows the swing trainer 20 reconfigured as an over-the-putter putting aid, using the power line T configuration of FIG. 7 with the addition of two shorter extension tubes 36 (seen previously in FIG. 5) and 38 and a tensioned cord 40. Front-back tube 22 (or another tube such as 122) counterbalances angled tubes 36 and 38 and line 40, making the trainer free-standing over the swing path of putter head 112*a* and the hole or putting disk 200 or 202. The golfer stands on the "outside" of the frame, and attempts to keep the putter head 112*a* in line with cord 40 throughout the stroke. This putting aid configuration is useful both indoors and out. By placing the ball 11 at an easily distinguished or marked location such as the centered zero of the scale 24*a* on tube 24, the golfer can additionally watch how far back and forth the putter head moves from center during the stroke, making adjustments as necessary.

Figure 8:
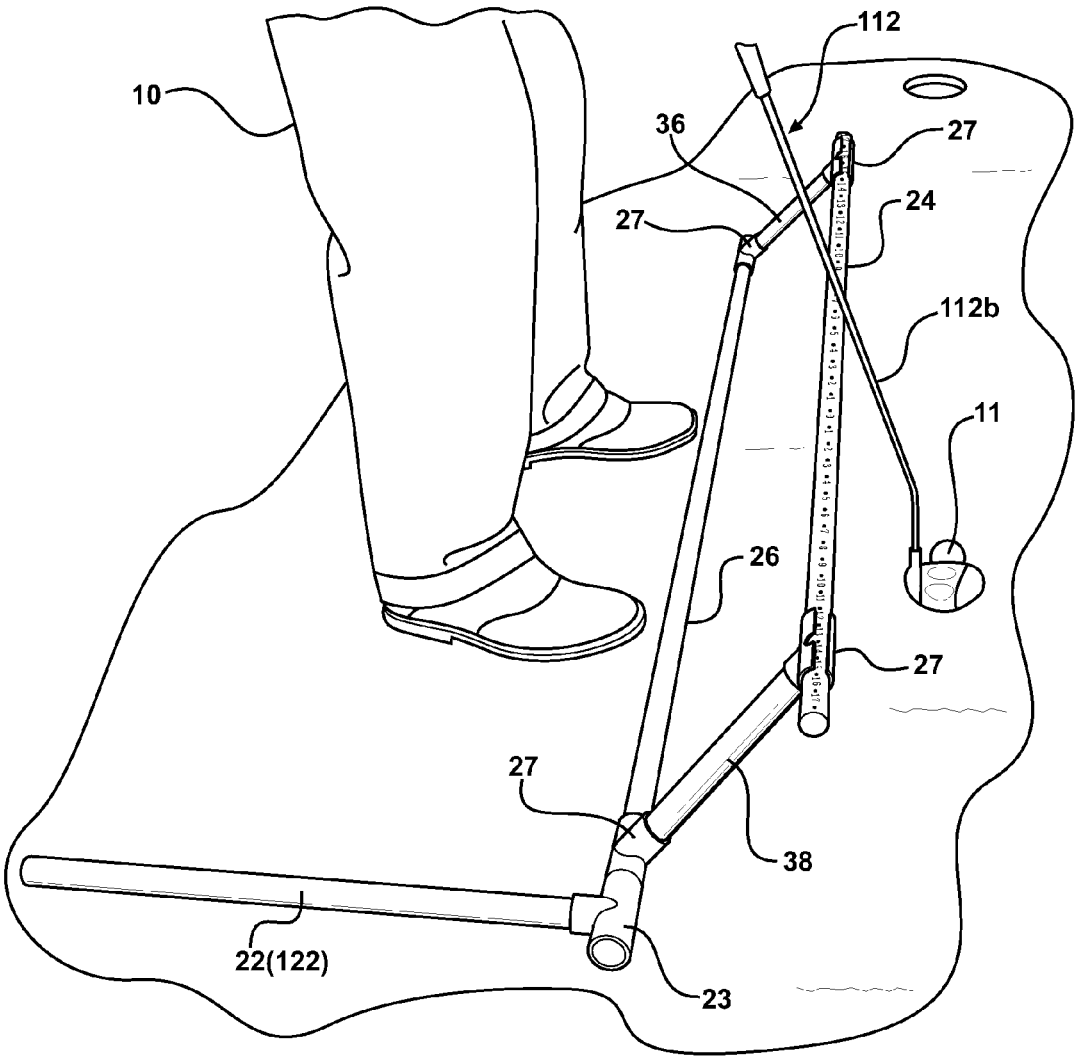
FIG. 8 is an aft perspective view of the shorter frame members of FIG. 7 modified to support an elongated tube raised above and parallel to the ground frame member as a putting guide in contact with the putter shaft throughout the backstroke and forward stroke.
Figure 8A:
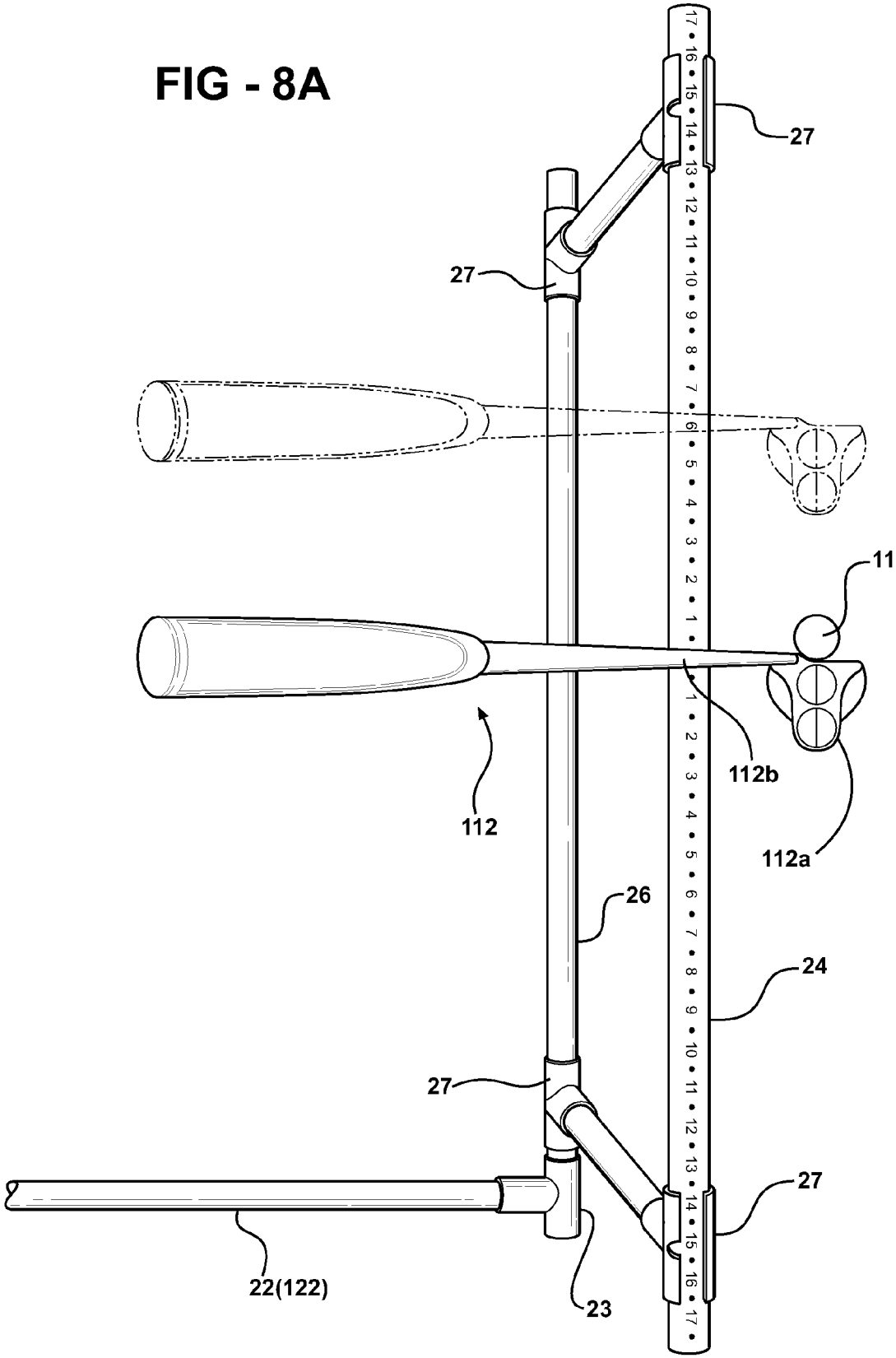
FIG. 8A is a back (golfer's eye) perspective view of the putting guide of FIG. 8.

Referring to FIGS. 8 and 8A, a modified putting guide is shown using the right-angled ground frame members 22 and 26 as a base, and connecting numbered fore-aft tube 24 in parallel above and in front of tube 26 using shorter angled tubes 36 and 38 and connectors 27. The golfer stands on the "inside" of the ground frame, and rigid upper fore-aft tube 24 forms an unyielding straight shaft guide for putter shaft 112*b* to slide along throughout the putt. By marking tube 24 at 24*a* such as with a +/− inches scale centered at zero, a very precise measurement of the distance traveled by putter shaft 112*b* (and thus head 112*a*) both fore and aft from center can be watched by the golfer, training the golfer to make a "pendulum" stroke.

Figure 9:
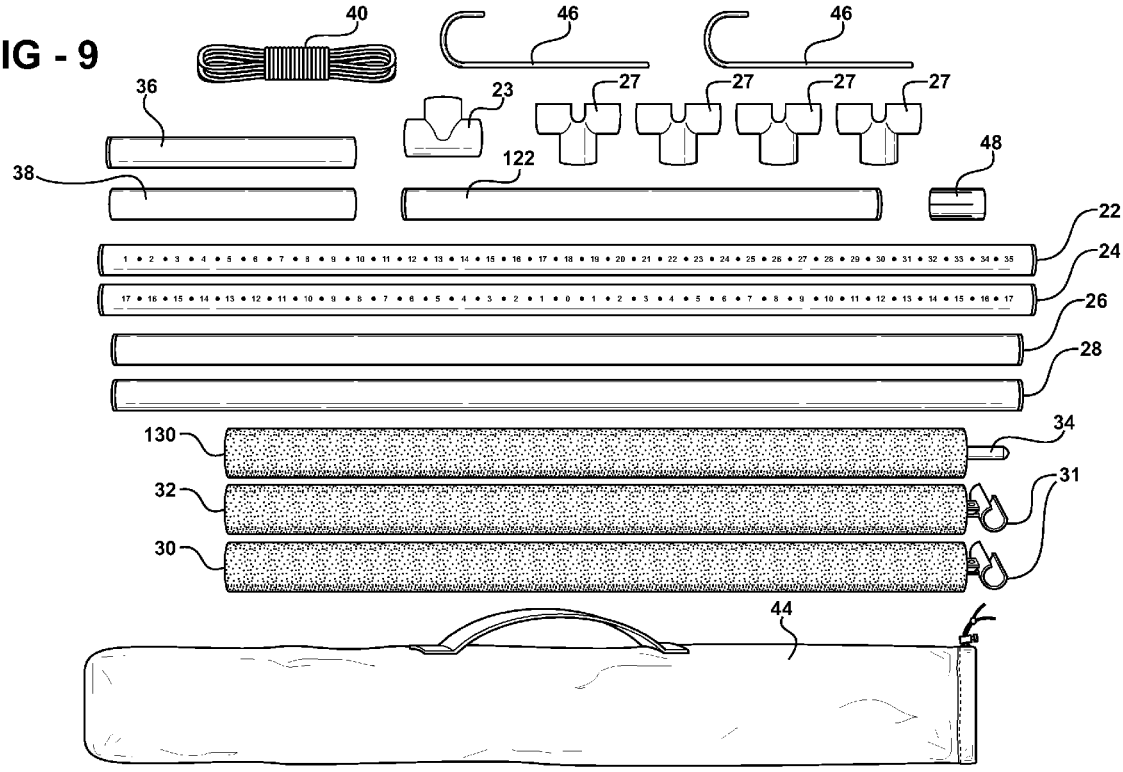
FIG. 9 is a plan view of a preferred assortment of the swing trainer members of FIGS. 1-8 for use as a kit, disassembled for storage and transport.

FIG. 9 shows the various tubes, rods, and connectors from FIGS. 1-8 in kit form, where they have been disassembled for storage and/or transport in a compact storage/carrying bag 44. The kit selection of FIG. 9 also shows stakes 46 useful for securing the ground frame members of the trainer securely to the ground. It will be understood that although this particular selection of parts is a currently preferred selection, other combinations of the basic parts shown above in FIGS. 1-8 could be selected for a desired kit, and of course more or fewer of each of the parts shown in FIG. 9 could be chosen for a particular kit configuration. And, parts different from those shown could be added to the existing selection, or perhaps substituted for some of them, provided the kit still supplies the basic adjustable, right-angled ground frame members and the tilt-adjustable uprights. It will further be understood that even limited to the parts shown in the exemplary kit selection of FIG. 9, the configurations of the swing trainer 20 shown in FIGS. 1-8 is not exhaustive, and that the various members and connectors could be connected in additional configurations for additional swing exercises.

Figure 10:
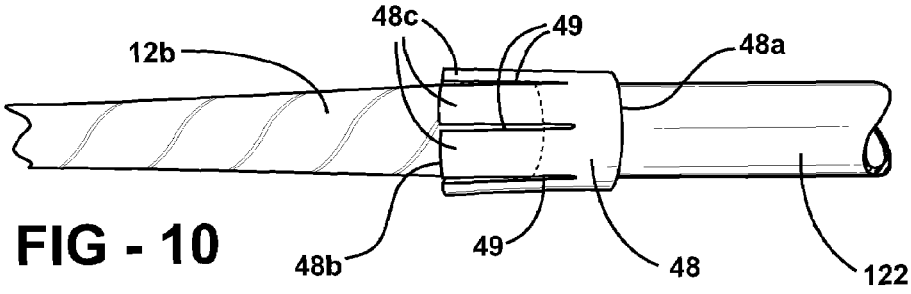
FIG. 10 is a detailed perspective view of the grip-connecting end of a grip extension used for a chipping exercise, which extension can be incorporated into one of the tube members in the swing trainer kit of FIG. 9.
Figure 10A:
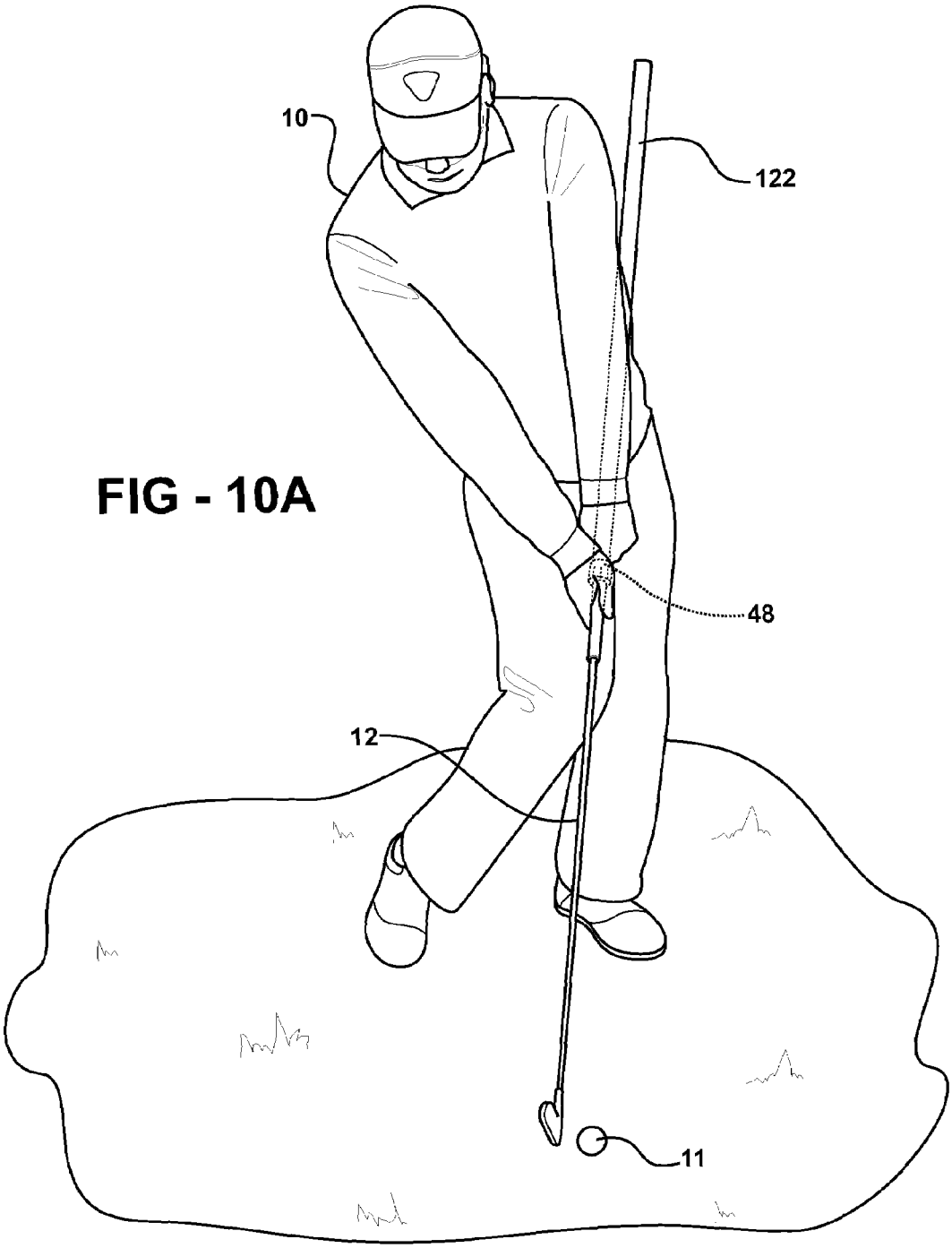
FIG. 10A shows a golfer performing a chipping exercise with the grip extension of FIG. 10.

FIG. 10 illustrates a chipping tube connector 48 useful to connect one of the hollow PVC tubes of FIGS. 1-9 (tube 122 in the example of FIG. 10) to the end of the grip 12*a* of a chipping iron 12 to form an axial extension of the grip for a known chipping exercise in which the golfer's left arm and wrist are encouraged to remain straight throughout the swing. Chipping tube connector 48 is a short length of hollow PVC tubing with an interior shoulder (not shown, but known in common PVC push-fittings used in plumbing applications) to make a push-fit frictional connection at one end 48*a* with the end of one of the ground frame tubing members of FIGS. 1-9. The grip-connecting end 48*b* has a circumferential pattern of axial slots 49 that divide the grip-connecting end into cantilevered fingers 48*c*, permitting them to expand to fit over the end of grip 12*a*. The flexibility of fingers 48*c* allows the connector and any attached tube extension to be levered off the end of the club grip if the chip or other stroke is done badly, such as "flipping" the wrist, without damage to the connector, the grip, or the golfer. The flexibility of fingers 48*c* will also generally allow connector 48 to fit a variety of club grips for similar exercises.

Although connector 48 is illustrated as a separate piece for connecting one of the ground frame members 22, 24, 122, etc. to grip 12*b*, it will be understood that connector 48 could be formed with an integral tube extension on end 48*a* so that it functions as a one-piece, stand-alone extension of the golf club grip.

It will be understood that the disclosed embodiments are representative of presently preferred forms of the invention, but are intended to be illustrative rather than definitive of the invention. The scope of the invention is defined by the following claims.

I accordingly claim:

1. A golf swing trainer comprising:

a ground alignment frame that lies essentially flat on the ground, the ground alignment frame comprising guide members including a straight, elongated front-back guide member generally perpendicular to a golfer's line of swing, and at least two straight, elongated fore-aft guide members connected at generally right angles to the front-back guide member generally parallel to one another and to a golfer's line of swing and spaced apart a distance sufficient to permit a golf club head to pass between them along the ground in the line of swing, the fore-aft guide members having free ends pointing in a swing direction to define an open-ended swing path along the ground, a first one of the at least two fore-aft guide members being connected to the front-back guide member with an adjustable connection enabling the first fore-aft guide member to be adjustably spaced from a second one of the fore-aft guide members on the front-back guide member to vary its parallel spacing relative to the second fore-aft guide member; and, a first tilt-adjustable upright guide member having a free upper end and having a lower end adapted to be connected to one of the ground alignment frame guide members with an adjustable tilt connection enabling the upright guide member to be connected at different locations and adjusted to different angles on the one of the ground alignment frame guide members and a second tilt-adjustable upright guide member adapted to be connected to one of the ground alignment frame guide members with an adjustable tilt connection enabling the second tilt-adjustable upright guide member to be connected to one of the ground alignment frame guide members in a manner spaced from and parallel to the first tilt-adjustable upright guide member to define a swing plane path for a golf club between them.

2. The golf swing trainer of claim 1, wherein the second tilt-adjustable upright guide member is adapted to be removed from the ground alignment frame and connected axially to an upper free end of the first tilt-adjustable upright guide member to form a single taller tilt-adjustable upright guide member.

3. A golf swing trainer comprising:

a ground alignment frame that lies essentially flat on the ground, the ground alignment frame comprising guide members including a straight, elongated front-back guide member generally perpendicular to a golfer's line of swing, and at least two straight, elongated fore-aft guide members connected at generally right angles to the front-back guide member generally parallel to one another and to a golfer's line of swing and spaced apart a distance sufficient to permit a golf club head to pass between them along the ground in the line of swing, the fore-aft guide members having free ends pointing in a swing direction to define an open-ended swing path along the ground, a first one of the at least two fore-aft guide members being connected to the front-back guide member with an adjustable connection enabling the first fore-aft guide member to be adjustable spaced from a second one of the fore-aft guide members on the front-back guide member to vary its parallel spacing relative to the second fore-aft guide member; and, a first tilt-adjustable upright guide member having a free upper end and having a lower end adapted to be connected to one of the ground alignment frame guide members with an adjustable tilt connection enabling the upright guide member to be connected at different locations and adjusted to different angles on the one of the ground alignment frame guide members, and a pair of shorter front-back members adapted to be secured at spaced locations on one of the fore-aft members at an acute angle raised off the ground, and an elongated elevated guide member adapted to be secured between the angle members above the one of the fore-aft members in parallel with and at an acute angle to the one of the fore-aft members.

4. The golf swing trainer of claim 3, wherein the elongated elevated guide member is a rigid member.

5. The golf swing trainer of claim 4, wherein the elongated elevated guide member includes markings for gauging the distance a putter moves through a putting stroke.

6. The golf swing trainer of claim 3, wherein the elongated elevated guide member is a cord.

* * * * *